US011779165B2

(12) United States Patent
Lin

(10) Patent No.: US 11,779,165 B2
(45) Date of Patent: Oct. 10, 2023

(54) SOAP DISPENSING APPARATUS

(71) Applicant: Po-Hui Lin, Taipei (TW)

(72) Inventor: Po-Hui Lin, Taipei (TW)

(73) Assignee: Ableman International Co., Ltd., Taipei (TW)

( * ) Notice: Subject to any disclaimer, the term of this patent is extended or adjusted under 35 U.S.C. 154(b) by 0 days.

(21) Appl. No.: 17/930,707

(22) Filed: Sep. 8, 2022

(65) Prior Publication Data

US 2023/0000292 A1 Jan. 5, 2023

(51) Int. Cl.
*A47K 5/12* (2006.01)

(52) U.S. Cl.
CPC ..... *A47K 5/1217* (2013.01); *A47K 5/1202* (2013.01); *A47K 2005/1218* (2013.01)

(58) Field of Classification Search
CPC ..... A47K 5/1217; A47K 5/1202; A47K 2005/1218
See application file for complete search history.

(56) References Cited

U.S. PATENT DOCUMENTS 8,240,508 B2 * 8/2012 Wegelin ..... G05B 15/02 222/105
8,751,037 B2 * 6/2014 Peters ..... B67D 1/0888 221/96
11,135,332 B1 * 10/2021 Buckler ..... G07C 9/22
2005/0127090 A1 * 6/2005 Sayers ..... G07C 9/00896 222/1
2010/0163573 A1 * 7/2010 Wegelin ..... B67D 7/08 222/325
2012/0226446 A1 * 9/2012 Nelson ..... G16H 40/60 73/61.41
2013/0292407 A1 * 11/2013 Beavis ..... F04B 13/00 222/23
2023/0000292 A1 * 1/2023 Lin ..... A47K 5/1217

FOREIGN PATENT DOCUMENTS

DE 102017119978 A1 * 2/2019 ..... A47K 5/1217
JP 2019017672 * 2/2019
WO WO-2006058650 A1 * 6/2006 ..... E03C 1/04

* cited by examiner

*Primary Examiner* — Bob Zadeh

(57) ABSTRACT

A soap dispenser includes a spout; a controller; a barcode scanner electrically connected to the controller; a power supply electrically connected to the controller; and a soap reservoir including a label having a barcode containing information including a set count of dispensing times of the soap reservoir and a current count of dispensing times of the soap reservoir. The spout includes an electromagnetic switch, an infrared sensor, and a pump in fluid communication with the soap reservoir and electrically connected to the electromagnetic switch respectively. The barcode scanner scans the barcode and sends same to the controller for storage. The controller compares the set count of dispensing times of the soap reservoir with the current count of dispensing times of the soap reservoir prior to activating the pump. After the pumping, the controller increases the current count of dispensing times of the soap reservoir by one.

1 Claim, 2 Drawing Sheets

SOAP DISPENSING APPARATUS

FIELD OF THE INVENTION

The invention relates to soap dispensers and more particularly to a soap dispensing apparatus including a controller for storing a predetermined count of dispensing times of the soap reservoir and a current count of dispensing times of the soap reservoir, the two counts being compared with each other prior to allowing a dispensing operation to activate or not.

BACKGROUND OF THE INVENTION

A conventional soap dispenser mounted in a sink is not equipped with a counter to count a current count of dispensing times of a soap reservoir. Thus, an individual is not aware whether the soap reservoir is consumed or not. It is often that the individual may try a number of times to activate the soap dispenser. However, it not only frustrates the individual but also causes the soap dispenser to malfunction.

Thus, the need for improvement still exists.

SUMMARY OF THE INVENTION

It is therefore one object of the invention to provide a soap dispensing apparatus comprising a spout; a controller; a barcode scanner electrically connected to the controller; a power supply electrically connected to the controller; and a soap reservoir including a label having a barcode containing information including kind of liquid stored in the soap reservoir, a predetermined count of dispensing times of the soap reservoir, and a current count of dispensing times of the soap reservoir, the current count of dispensing times of the soap reservoir being initially set as zero; wherein the spout includes an electromagnetic switch, an infrared sensor, and a pump in fluid communication with the soap reservoir and electrically connected to the electromagnetic switch respectively; wherein the barcode scanner is configured to scan the barcode and sends same to the controller for storage; wherein the controller is configured to compare the predetermined count of dispensing times of the soap reservoir with the current count of dispensing times of the soap reservoir prior to activating the pump; wherein in response to activating the infrared sensor, an act of pumping begins if the predetermined count of dispensing times of the soap reservoir is greater than the current count of dispensing times of the soap reservoir; and wherein in response to the act of pumping, the controller increases the current count of dispensing times of the soap reservoir by one.

The above and other objects, features and advantages of the invention will become apparent from the following detailed description taken with the accompanying drawings.

DETAILED DESCRIPTION OF THE INVENTION

Figure 1:
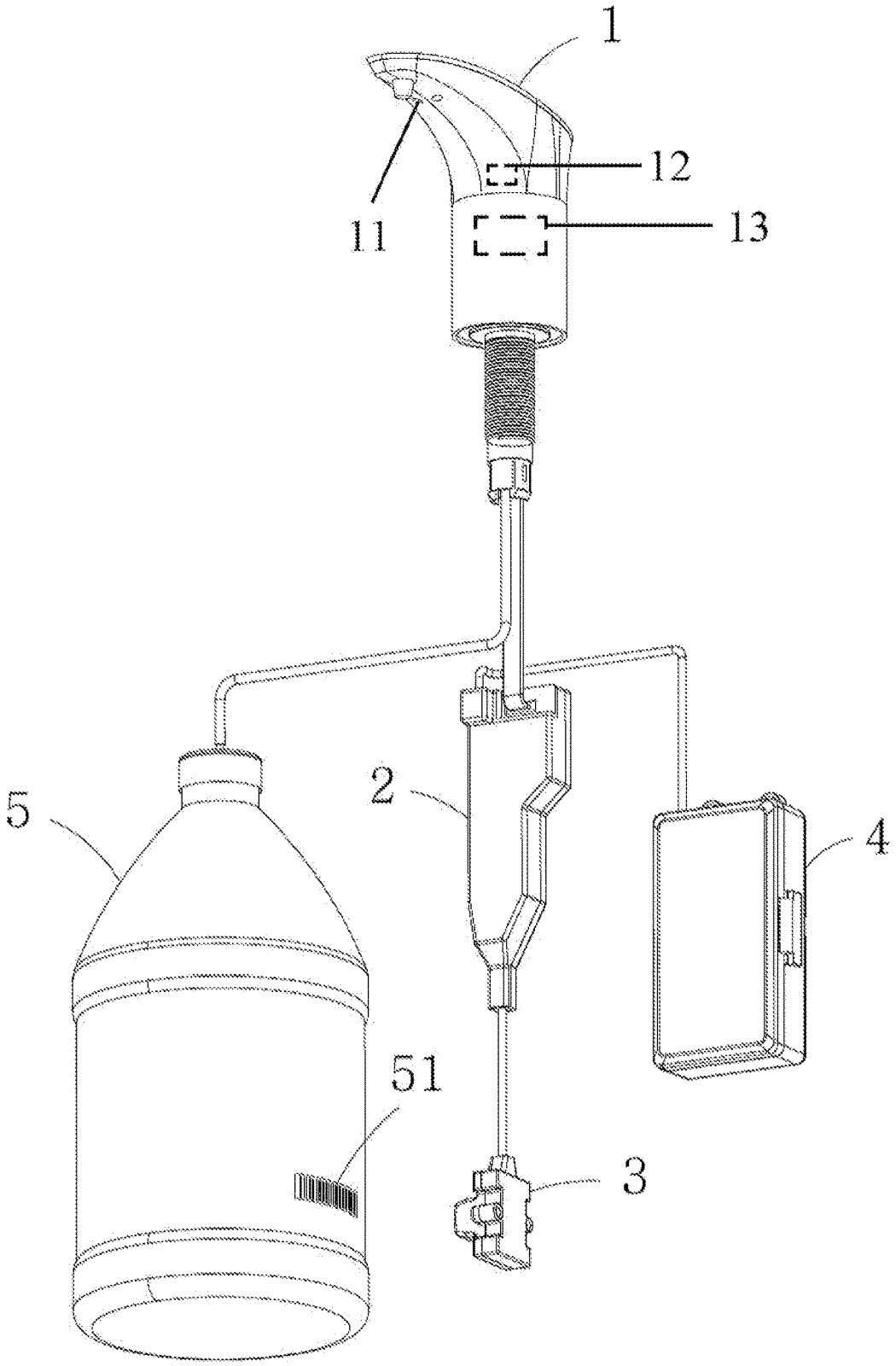
FIG. 1 schematically depicts a soap dispensing apparatus of the invention.

Referring to FIG. 1, a soap dispensing apparatus of the invention comprises a spout 1, a controller 2, a barcode scanner 3 electrically connected to the controller 2, a power supply (e.g., battery or adapter) 4 electrically connected to the controller 2, and a soap reservoir 5 including a label 51 for identifying the soap reservoir 5.

The spout 1 includes an infrared sensor 11 for tracking proximity of an object, an electromagnetic switch 12, and an internal pump 13 in fluid communication with the soap reservoir 5 and electrically connected to the electromagnetic switch 12 respectively. The barcode scanner 3 can be used to scan a barcode on the label 51 and sends same to the controller 2. The barcode contains kind of liquid (e.g., soap) stored in the soap reservoir 5, a predetermined count of dispensing times of the soap reservoir 5, and a current count of dispensing times of the soap reservoir 5 in which the current count of dispensing times of the soap reservoir 5 is set as zero when the soap reservoir 5 is newly installed. Thus, the kind of liquid stored in the soap reservoir 5, the predetermined count of dispensing times of the soap reservoir 5, and the current count of dispensing times of the soap reservoir 5 are stored in the controller 2.

Figure 2:
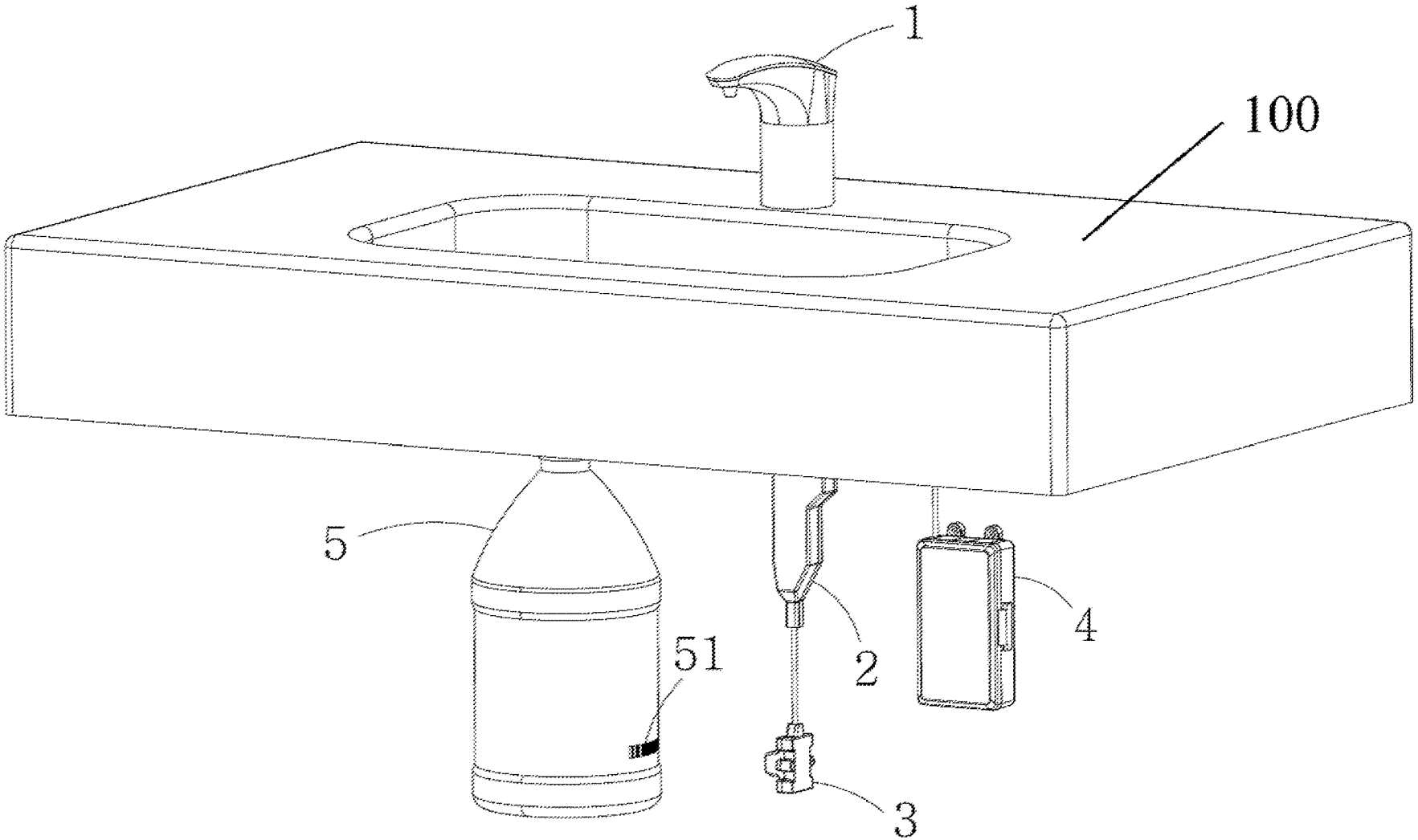
FIG. 2 schematically depicts the soap dispensing apparatus mounted in a sink.

Referring to FIG. 2 in conjunction with FIG. 1, the soap dispensing apparatus is installed in a sink 100. In use, a user may place the hand in close proximity to the infrared sensor 11. The infrared sensor 11 may sense the hand and sends a signal to the controller 2 which in turn turns on the electromagnetic switch 12 which in turn activates the pump 13. The pump 13 transfers liquid in the soap reservoir 5 to the spout 1 for washing the hand. After the washing (i.e., after performing the act of pumping for a predetermined period of time (e.g., 10 seconds)), the electromagnetic switch 12 is automatically turned off by the controller 2 and the controller 2 increases the current count of dispensing times of the soap reservoir 5 by one.

Prior to the dispensing operation, the controller 2 compares the predetermined count of dispensing times of the soap reservoir 5 with the current count of dispensing times of the soap reservoir 5. The dispensing operation will begin if the predetermined count of dispensing times of the soap reservoir 5 is greater than the current count of dispensing times of the soap reservoir 5. To the contrary, the dispensing operation will not begin if the predetermined count of dispensing times of the soap reservoir 5 is equal to the current count of dispensing times of the soap reservoir 5 (i.e., the soap reservoir 5 consumed).

An individual may fill up the consumed soap reservoir 5 with soap and adhere a new label 51 on the soap reservoir 5. Next, the individual uses the barcode scanner 3 to scan a barcode on the label 51 and sends same to the controller 2. The barcode contains kind of liquid stored in the soap reservoir 5, a predetermined count of dispensing times of the soap reservoir 5, and a current count of dispensing times of the soap reservoir 5 in which the current count of dispensing times of the soap reservoir 5 is set as zero when the soap reservoir 5 is full of liquid (e.g., soap). Thus, the kind of liquid stored in the soap reservoir 5, the predetermined count of dispensing times of the soap reservoir 5, and the current count of dispensing times of the soap reservoir 5 are stored in the controller 2.

While the invention has been described in terms of preferred embodiments, those skilled in the art will recognize that the invention can be practiced with modifications within the spirit and scope of the appended claims.

What is claimed is:

1. A soap dispensing apparatus comprising:

a spout;

a controller;

a barcode scanner electrically connected to the controller;

a power supply electrically connected to the controller; and a soap reservoir including a label having a barcode containing information including a predetermined count of dispensing times of the soap reservoir and a current count of dispensing times of the soap reservoir, the current count of dispensing times of the soap reservoir being initially set as zero;

wherein the spout includes an electromagnetic switch, an infrared sensor, and a pump in fluid communication with the soap reservoir and electrically connected to the electromagnetic switch respectively;

wherein the barcode scanner is configured to scan the barcode and send the information to the controller for storage;

wherein the controller is configured to compare the predetermined count of dispensing times of the soap reservoir with the current count of dispensing times of the soap reservoir;

wherein in response to activating the infrared sensor, an act of pumping begins if the predetermined count of dispensing times of the soap reservoir is greater than the current count of dispensing times of the soap reservoir; and wherein in response to the act of pumping, the controller increases the current count of dispensing times of the soap reservoir by one.

* * * * *